United States Patent [19]

Jaeger et al.

[11] Patent Number: 4,612,016

[45] Date of Patent: Sep. 16, 1986

[54] PROCESS FOR DYEING CELLULOSIC TEXTILE MATERIALS

[75] Inventors: Carl A. Jaeger, Steinen, Fed. Rep. of Germany; Hans-Ulrich Berendt, Allschwil; Paul Schäfer, Riehen, both of Switzerland

[73] Assignee: Ciba-Geigy Corporation, Ardsley, N.Y.

[21] Appl. No.: 706,226

[22] Filed: Feb. 27, 1985

[30] Foreign Application Priority Data

Mar. 8, 1984 [CH] Switzerland ..... 1148/84

[51] Int. Cl.[4] ..... D06B 1/02; D06P 1/52; D06P 3/62

[52] U.S. Cl. ..... 8/543; 8/444; 8/499; 8/554; 8/555; 8/918

[58] Field of Search ..... 8/555, 543, 499, 554

[56] References Cited

U.S. PATENT DOCUMENTS 4,304,567 12/1981 Ballmann et al. ..... 8/543

4,323,363 4/1982 Brachten et al. ..... 8/532

4,397,650 8/1983 Gregorian et al. ..... 8/477

4,494,956 1/1985 Schafer et al. ..... 8/543

*Primary Examiner*—A. Lionel Clingman

*Attorney, Agent, or Firm*—Edward McC. Roberts; Meredith C. Findlay; Kevin T. Mansfield

[57] ABSTRACT

Cellulosic textile material is dyed with substantive dyes or preferably with reactive dyes. Dyeing is carried out by applying to the cellulosic material, by a non-pad method, an aqueous dye liquor which contains, in addition to the dye, a graft polymer which is obtained from an adduct of an alkylene oxide, preferably propylene oxide, with an at least trihydric aliphatic alcohol, e.g. glycerol, and acrylamide or methacrylamide. The cellulosic material is then subjected to a heat treatment, e.g. by steaming or with microwaves, or is preferably stored cold, to fix the dyes.

This dyeing process affords dyeings with excellent penetration of the fabric and with level depth of shade from edge to edge.

18 Claims, No Drawings

PROCESS FOR DYEING CELLULOSIC TEXTILE MATERIALS

The present invention relates to a process for dyeing textile materials which consist wholly or partly of cellulose fibres with substantive dyes or, preferably, with reactive dyes.

Whereas good penetration of the goods is achieved when dyeing tubular fabric, for example cotton tricot, on the pad, undesirable nip marks can also result from padding. It is known that the risk of nip marks can be obviated by spraying the fabric with the dye liquor. However, even when using good wetting agents, the spray-on method gives insufficient penetration of the goods with the dye liquor and an unsatisfactory appearance. The present invention has for its object:

(a) to avoid nip marks and to achieve a satisfactory appearance of the dyed fabric, and (b) to improve the penetration of the goods by a non-pad method of impregnation, for example by spraying the goods with the dye liquor.

Accordingly, the present invention relates to a process for dyeing cellulosic textile fabric with substantive or reactive dyes, by impregnating said fabric with an aqueous dye liquor by a non-pad method and fixing the dyes by means of a heat treatment or by the cold pad-batch method, which dye liquor contains, in addition to dyes and, optionally, further auxiliaries, a homopolymer or copolymer of acrylamide or methacrylamide, or a graft polymer of an adduct of an alkylene oxide and an at least trihydric aliphatic alcohol containing 3 to 10 carbon atoms and methacrylamide or preferably acrylamide. The dye liquor can also contain mixtures of said polymers.

Polymers based on acrylamide or methacrylamide and suitable for use in the process of this invention are preferably the graft polymers as defined above.

Preferred graft polymers are those obtained by graft polymerisation of methacrylamide or, preferably, acrylamide to an adduct of 4 to 100 moles, preferably 40 to 80 moles, of propylene oxide with trihydric to hexahydric alkanols of 3 to 6 carbon atoms. These alkanols can be straight chain or branched. Representative examples are glycerol, trimethylolethane, trimethylolpropane, erythritol, pentaerythritol, mannitol or sorbitol.

Preferred graft polymers are those obtained by grafting methylacrylamide or acrylamide to adducts of mixtures of ethylene oxide or propylene oxide or also of ethylene oxide alone to the above mentioned polyhydric alcohols. Particularly suitable graft polymers are those of acrylamide and adducts of 40 to 80 moles of propylene oxide with 1 mole of glycerol.

The graft polymers employed in the practice of this invention advantageously contain 2.5 to 50% by weight of the defined adduct as main chain and 50 to 97.5% by weight of grafted methacrylamide or, preferably acrylamide as side chains.

The graft polymers preferably contain 2.5 to 30% by weight of the alkylene oxide adduct and 70 to 97.5% by weight of grafted methacrylamide or, preferably, acrylamide. More preferably, the amide component is 80 to 97,5% by weight, based on the graft polymer. Those products are particularly preferred which contain, as main chain, 4 to 10% by weight of the adduct of 40 to 80 moles of propylene oxide with 1 mole of glycerol and 90 to 96% by weight of acrylamide.

The percentages are based on the entire graft polymer.

The graft polymers of this invention are prepared by methods which are known per se, conveniently by polymerising (1) an adduct of an alkylene oxide and an at least trihydric aliphatic alcohol of 3 to 10 carbon atoms with (2) acrylamide or methacrylamide, and in the presence of a catalyst, preferably in the temperature range from 40° to 100° C. There are thus obtained substantially graft polymers in which the alkylene oxide adduct forms the main chain which, at individual carbon atoms, contains the grafted acrylamide or methacrylamide in the form of side chains.

The catalysts employed are advantageously organic or preferably inorganic initiators which form free radicals. Suitable organic initiators for carrying out the radical polymerisation are e.g. symmetrical peroxide dicarbonates, butyl peroctoates, butyl perbenzoates, peracetates or peroxide dicarbamates. Suitable inorganic initiators are hydrogen peroxide, perborates, persulfates or peroxydisulfates. The preferred initiator or activator is potassium peroxydisulfate.

These catalysts can be used in amounts of 0.05 to 5% by weight, preferably of 0.05 to 2% by weight and, most preferably, of 0.1 to 1% by weight, based on the starting materials.

The graft polymerisation is conveniently carried out in an inert atmosphere, e.g. in the presence of nitrogen.

The graft polmers are advantageously obtained in the form of highly viscous solutions. Gel-like products having a solids content of e.g. 0.5 to 20% by weight, preferably 2 to 20% by weight, can be prepared by dissolving these polymers in, and diluting them with, water. To preserve the aqueous solutions of the graft polymers and/or to improve their storage stability, it is possible to add preservatives such as chloroacetamide, N-hydroxymethylchloroacetamide, pentachlorophenolates, alkali metal nitrites, triethanolamine or, preferably, hydroquinone monomethyl ether, or also bactericides such as sodium azide or surface-active quaternary ammonium compounds which contain one or two fatty alkyl radicals. It is also advantageous to use mixtures of these preservatives and antimicrobial compounds.

The particularly preferred 2 to 5% solutions of the graft polymers have a viscosity of 3000 to 150,000 mPa.s, preferably of 15,000 to 120,000 mPa.s and, most preferably, of 40,000 to 80,000 mPa.s (milli-Pascal seconds). The polyalkylene oxide adducts employed to prepare the graft polymers normally have a molecular weight of 400 to 6000, preferably 3000 to 4500.

Instead of using the specified graft polymers for impregnating, it is also possible to use linear or branched polymers of acrylamide or methacrylamide as well as copolymers of acrylamide or methacrylamide and further ethylenically unsaturated monomers, for example acrylic acid, methacrylic acid, α-haloacrylic acid, 2-hydroxyethylacrylic acid, α-cyanoacrylic acid, crotonic acid, vinylacetic acid, maleic acid, acrylonitrile, methacrylonitrile, vinyl alkyl ethers (methyl vinyl ether, isopropyl vinyl ether), vinyl esters (vinyl acetate), styrene, vinyl toluene, vinylsulfonic acid, 2-acrylamido-2-methylpropanesulfonic acid, or esters of the above specified α,β-unsaturated carboxylic acids and, in particular, half esters of maleic acid with adducts of 2 to 15 moles of ethylene oxide and monoalcohols of 8 to 22 carbon atoms. The weight ratio of acrylamide to the other monomers is preferably from 9:1 to 1:1.

The amount in which the acrylamide polymers are used alone or in admixture in the dye liquors can vary within wide limits. Amounts of 0.1 to 20 g, preferably 0.5 to 10 g and, most preferably, 1 to 5 g per liter of dye liquor, in the form of 2 to 10% aqueous solutions, have proved advantageous.

The dyes employed in the process of this invention are the substantive dyes or, in particular, reactive dyes conventionally employed for dyeing cellulosic materials.

Suitable substantive dyes are the conventional direct dyes, for example those listed under the heading "Direct Dyes" in the Colour Index, 3rd edition (1971), Vol. 2, on pages 2005–2478.

By reactive dyes are meant the conventional dyes which form a covalent bond with cellulose, e.g. those listed under the heading "Reactive Dyes" in the Colour Index, Vol. 3, 3rd. edition (1971), on pages 3391–3560, and in Vol. 6, revised 3rd edition (1975), on pages 6268–6345.

The amount of dye in the dye liquor will normally depend on the desired colour strength and is conveniently 0.1 to 80 g/l preferably 2 to 50 g/l.

When using reactive dyes, the formulations will normally contain fixation alkalies.

Representative examples of the alkalies employed for fixing the reactive dyes are sodium carbonate, sodium bicarbonate, sodium hydroxide, disodium phosphate, trisodium phosphate, borax, aqueous ammonia, or alkali donors such as sodium trichloroacetate. A very suitable alkali is in particular a mixture of water glass and a 30% aqueous sodium hydroxide solution. The pH of the alkaline dye liquors is generally from 7.5 to 13.2, preferably from 8.5 to 11.5.

The dye liquors are conveniently prepared by dissolving the dye and adding the graft polymer and alkali. Depending on the dye employed, the dye liquors can contain conventional additives, e.g. electrolytes such as sodium chloride or sodium sulfate, as well as chelating agents, antioxidants such as sodium nitrobenzenesulfonate, and also urea, glycerol and/or sodium formate. If desired, thickeners such as alginates, starch ethers or carob bean gum can also be added to the dye liquors.

Besides the graft polymers, it is often advantageous to add commercially available alkali-resistant wetting agents to the dye liquors, e.g. sulfonates of polycarboxylic acid esters such as dihexylsulfosuccinates or dioctylsulfosuccinates; alkylarylsulfonates with linear or branched alkyl chain containing not less than 6 carbon atoms, e.g. dodecylbenzenesulfonates or, preferably, alkylsulfonates containing 8 to 20 carbon atoms in the alkyl chain, e.g. dodecylsulfonates or pentadecylsulfonates. The sulfonates suitable as wetting agents are usually in the form of alkali metal salts, preferably of sodium or ammonium salts.

The amounts in which the wetting agents are added to the padding liquors preferably vary from 1 to 20 g/l, preferably from 2 to 10 g/l.

An advantageous embodiment of the process of this invention comprises impregnating the cellulosic material with a dye liquor which contains the graft polymer in conjunction with a wetting agent consisting of (A) an alkylsulfonate which contains 8 to 20 carbon atoms in the alkyl chain, and (B) an adduct of 2 to 40 moles of ethylene oxide with 1 mole of a fatty alcohol or fatty acid, each containing 8 to 22 carbon atoms, or with 1 mole of an alkylphenol containing a total of 4 to 12 carbon atoms in the alkyl moiety. The weight ratio of component (A) to component (B) is normally from 5:1 to 1:1, preferably from 5:1 to 2:1 and, most preferably, from 4:1 to 3:1.

Preferred ethylene oxide adducts (B) are those which are obtained by addition of 2 to 10 moles of ethylene oxide to 1 mole of a $C_8$–$C_{12}$ fatty alcohol.

The process of this invention is suitable for dyeing textiles which consist of or contain cellulose.

Suitable cellulosic material is that made of regenerated or, in particular, of natural cellulose, e.g. viscose staple fibre, viscose rayon, hemp, linen, jute, or preferably cotton, as well as fibre blends, e.g. polyamide/cotton blends or, preferably, polyester/cotton blends, the polyester component of which can be dyed with disperse dyes beforehand, simultaneously or subsequently. When dyeing fibre blends, it is also possible to spray them with acid or disperse dyes.

The textile fabric can be in any form of processing, for example of yarns, hanks, wovens, knits, felted fabrics, but preferably in the form of textile planar fabrics such as wovens, knitted goods or carpets, which fabrics consist wholly or partly of natural, regenerated or modified cellulose. Both crude and pretreated goods can be employed. It is preferred to use raw cotton, for example in the form of tow or in tubular form.

The impregnation of the cellulosic textile fabric can be effected by coating or, preferably, by spraying on the dye liquor. When spraying the goods, the fibre material is conveniently sprayed finely from a jet, with the rate of flow being so adjusted as to give a liquor pick-up of 20 to 150%, preferably of 80 to 150%.

After they have been impregnated, the goods are subjected to a heat treatment in order to fix the dyes. Dye fixation is preferably effected by the cold pad-batch method.

The thermofixation can be effected by a steaming, hot dwell, thermosol or by a microwave process.

In the steaming process, the dyes are fixed by subjecting the textile materials impregnated with the dye liquor to a treatment with steam or superheated steam in a steamer, conveniently in the temperature range from 98° to 210° C., preferably from 100° to 180° C. and, most preferably, from 102° to 120° C.

In the hot dwell process, the impregnated goods are stored in the moist state for e.g. 15 to 120 minutes, preferably in the temperature range from 85° to 102° C. In this process, the goods can be preheated to 85°–102° C. by infrared irradiation. The preferred dwell temperature is from 95°–100° C.

Dye fixation by means of the thermosol process can be effected after, or without, an intermediate drying, e.g. at a temperature in the range from 100° to 210° C. It is preferred to carry out the thermosol process in the temperature range from 120° C. to 210° C., preferably from 140° to 180° C., and after the goods have been subjected to an intermediate drying at a temperature range of 80° to 120° C. Depending on the temperature, the thermosol fixation can take from 20 seconds to 5 minutes, preferably from 30 to 60 seconds.

The dyes can be thermofixed by means of microwaves. This is conveniently done by rolling up the goods after impregnation with the dye liquor and then exposing them to microwaves in a chamber.

The microwave treatment can taken from 2 to 120 minutes; but a treatment from 2 to 15 minutes is preferred. Microwaves are defined as electromagnetic waves (radio waves) in the frequency range from 300 to 100,000 MHz, preferably from 1000 to 30,000 MHz.

Dye fixation by the cold pad-batch method is effected by storing the padded goods, preferably rolled up, at room temperature (15°-30° C.), e.g. for 3 to 24 hours. The cold dwell time is, of course, dependent on the dye employed. If desired, the goods can also be stored at slightly elevated temperature (30°-80° C.).

Following the dyeing process, the dyed cellulosic material can be given a washing off in conventional manner to remove non-fixed dye. This is done by treating the substrate, e.g. at 40° C. to boiling temperature, in a solution which contains soap or a synthetic detergent. Treatment with a fixing agent can subsequently be effected to improve the wetfastness properties.

The process of this invention affords strong dyeings with a level appearance. In addition, the fastness properties of the dyed goods, for example lightfastness, rubfastness and wetfastness properties, are not adversely affected by the use of the acrylamide polymer as defined herein.

In particular, by not using a pad dyeing process it is possible to obtain an excellent penetration of the goods without nip marks, especially on untreated material. Further, the rapid run of the goods results in an increase in production. In addition, the spray properties of the spray liquor are not adversely affected owing to the low concentration of the acrylamide polymer employed in this invention.

In the following Preparatory and Use Examples, percentages are by weight, unless otherwise stated. The amounts of dye refer to commercially available, i.e. diluted, product, and the amounts of assistants to pure substance. The five-figure Colour Index (C.I.) numbers relate to the 3rd. edition of the Colour Index.

PREPARATORY EXAMPLES

Example 1

With stirring and under a stream of nitrogen, a solution of 22.5 g of acrylamide, 2.5 g of an adduct of 52 moles of propylene oxide with 1 mole of glycerol, and 0.04 g of potassium peroxy disulfate in 200 g of water is heated to 50° C. and kept at this temperature for 3 hours. Then a solution of 0.03 g of potassium peroxydisulfate in 40 g of water is added dropwise over 60 minutes and the highly viscous solution is diluted with 300 ml of water over 30 minutes. The reaction mixture is then kept for 5 hours at 50° C. and, after addition of 0.6 g of hydroquinone monomethyl ether and 0.12 g of sodium azide, cooled to room temperature with stirring, affording 565 g of a gel with a polymer content of 4.4%. This gel has a viscosity of 112957 mPa.s, measured at 25° C.

Example 2

With stirring and under a stream of nitrogen, a solution of 71.25 g of acrylamide, 3.75 g of an adduct of propylene oxide and glycerol with an average molecular weight of 4200, and 0.09 g of potassium peroxydisulfate in 600 g of water is heated to 50° C. and kept at this temperature for 3 hours. The viscosity of the solution gradually increases. Then a solution of 0.06 g of potassium peroxydisulfate in 120 g of water is added dropwise over 60 minutes. About 10 minutes after the start of the dropwise addition, the viscosity of the solution becomes so great that 600 g of water have to be added over the next 20 minutes. When the addition of potassium peroxydisulfate solution is complete, the increasingly viscous solution is kept for a further 5 hours at 50° C., while diluting it with an additional 400 g of water in portions. Then 1.7 g of hydroquinone monomethyl ether are added and the reaction mixture is cooled, with stirring, to room temperature, affording 1794 g of a free flowing gel with a polymer content of 4.3%. This gel has a viscosity of 64202 mPa.s, measured at 25° C.

Example 3

With stirring and under a stream of nitrogen, a solution of 71.25 g of acrylamide, 3.75 g of an adduct of propylene oxide and pentaerythritol with an average molecular weight of 3550, and 0.09 g of potassium peroxydisulfate in 600 g of water is heated to 50° C. and kept at this temperature for 3 hours. The viscosity of the solution gradually increases. Then a solution of 0.06 g of potassium peroxydisulfate in 120 g of water is added dropwise over 60 minutes. About 30 minutes after completion of the dropwise addition, the viscosity of the solution increases and 600 g of water are added over the next 20 minutes. The increasingly more viscous solution is then kept for a further 4 hours at 50° C. and subsequently diluted with an additional 400 g of water. After addition of 3.4 g of triethanolamine, the mixture is cooled to room temperature, affording 1793 g of a still fluid gel with a solids content of 4.0%. This gel has a viscosity of 75300 mPa.s, measured at 25° C.

Example 4

With stirring and under a stream of nitrogen, a solution of 17.8 g of acrylamide, 0.94 g of an adduct of 70 moles of propylene oxide and 6 moles of ethylene oxide with 1 mole of glycerol, and 0.025 g of potassium peroxydisulfate in 250 g of water is heated to 55° C. and kept for 3 hours at this temperature. The temperature of the solution is increased to 60°-63° C. over 20 minutes until the viscosity markedly increases, and the solution is then cooled to 55° C. The increasingly more viscous solution is kept for 5 hours at 55° C. Then a solution of 0.45 g of chloroacetamide and 0.45 g of hydroquinone monomethyl ether in 177 g of water is added to the viscous solution, affording 446 g of a gel with a graft polymer content of 4.2%. This gel has a viscosity of 96750 mPa.s, measured at 25° C.

Example 5

If the adduct used in Example 4 is replaced by a further adduct of 53 moles of propylene oxide with 1 mole of trimethylolpropane, there are obtained 446 g of a gel with a graft polymer content of 4.2%. This gel has a viscosity of 19500 mPa.s, measured at 25° C.

Example 6

With stirring and under a stream of nitrogen, a solution of 17.24 g of acrylamide, 4.31 g of an adduct of 70 moles of propylene oxide with 1 mole of glycerol, and 0.035 g of potassium peroxydisulfate in 200 g of water is heated to 50° C. and kept at this temperature for 4 hours. The increasingly more viscous solution is then heated for 5 hours to 55° C. To the resultant gel is added a solution of 0.4 g of chloroacetamide and 0.4 g of hydroquinone monomethyl ether in 291 g of water, affording 513 g of a gel with a polymer content of 4.2%. This gel has a viscosity of 25750 mPa.s, measured at 25° C.

Example 7

With stirring and under a stream of nitrogen, a mixture of 15.1 g of acrylamide, 6.5 g of an adduct of 70 moles of propylene oxide with 1 mole of glycerol, and 0.025 g of potassium peroxy disulfate in 200 g of water is heated to 50° C. and kept for 3 hours at this temperature. The increasingly more viscous solution is heated to 55° C. for 5 hours. To the resultant gel is added a solution of 0.4 g of chloroacetamide and 0.4 g of hydroquinone monomethyl ether in 291 g of water, affording 512 g of a gel with a polymer content of 4.2%. This gel has a viscosity of 16300 mPa.s, measured at 25° C.

Example 8

With stirring and under a stream of nitrogen, a mixture of 13 g of acrylamide, 8.7 g of an adduct of 70 moles of propylene oxide with 1 mole of glycerol, and 0.015 g of potassium peroxydisulfate in 150 g of water is heated to 50° C. and kept at this temperature for 4 hours. The increasingly more viscous solution is then heated for 2 hours to 65° C. and for a further 3 hours to 60° C. To the resultant gel is added a solution of 94 g of chloroacetamide and 0.4 g of hydroquinone monomethyl ether in 347 g of water, affording 519 g of a gel with a polymer content of 4.2%. This gel has a viscosity of 15582 mPa.s, measured at 25° C.

USE EXAMPLES

Example 1

An untreated cotton knitted fabric with a mass per unit area of 165 g/m$^2$ is sprayed with a liquor that contains 5 g/l of the dye of formula (11)

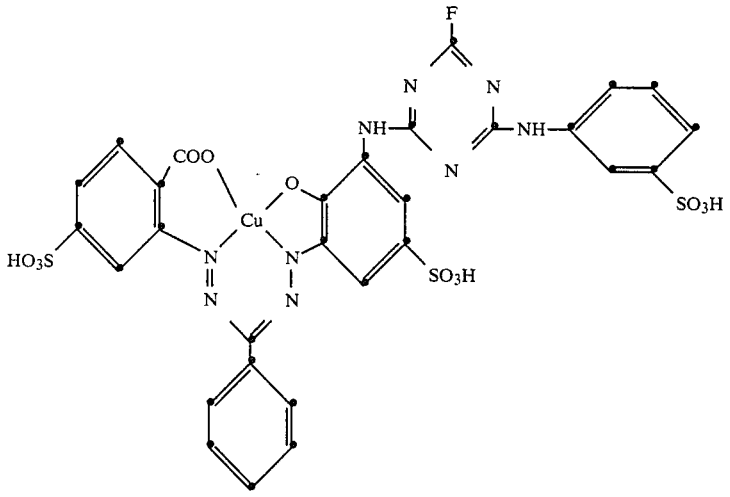

2 g/l of the graft polymer prepared according to Preparatory Example 2

5 g/l of an aqueous wetting agent containing 43% of pentadecane-1-sulfonic acid, sodium salt, 14% of a $C_9$–$C_{11}$ fatty alcohol polyglycol ether and 5% of 2-ethyl-1-hexanol, based on the entire wetting agent, 8 ml/l of 30% sodium hydroxide solution, and 48 ml/l of sodium silicate solution (silicate content: 26.3–27.7%).

The dye liquor is sprayed from a jet to give a fine distribution, with the rate of flow being so adjusted as to give a liquor pick-up of 120%. The knitted fabric is then placed in a container, packed airtight, and stored for 6 hours at 25° C. The fabric is then rinsed and washed for 20 minutes at boiling temperature with a non-ionic detergent (0.5 g/l of the adduct of 9 moles of ethylene oxide with 1 mole of nonylphenol) in a liquor ratio of 1:40. The substrate is subsequently rinsed again and dried. The strong blue dyeing so obtained is distinguished by good penetration of dye, a level appearance, and the absence of nip marks.

Comparably good dyeings are obtained by using the same amount of graft polymers prepared according to Examples 1 and 3 to 8 instead of the graft polymer of Example 2, as well as polyacrylamide in the form of a 4% aqueous solution having a viscosity of 28000 cps, measured at 25° C.

Example 2

A polyacrylonitrile cotton-backed plush fabric having a mass per unit area of 245 g/m$^2$ is padded to a pick-up of 100% with a liquor containing 5 g/l of the dye of formula (12)

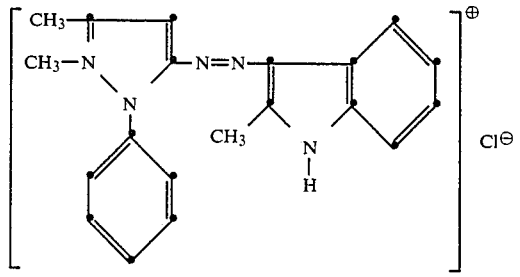

0.6 g/l of the dye of formula

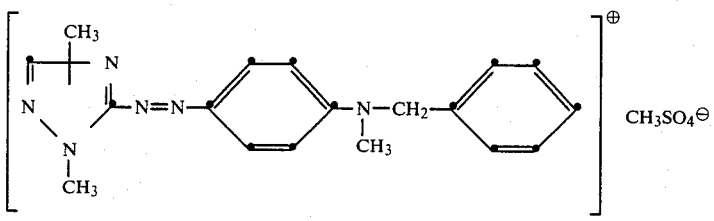

(13)

1.2 g/l of the dye of formula

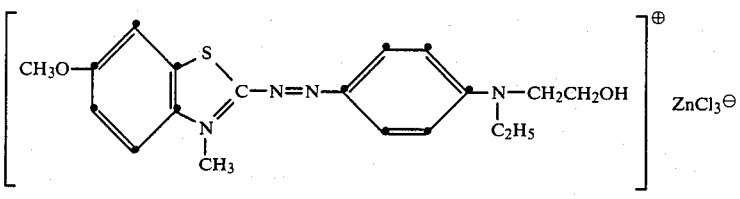

(14)

and 15 ml/l of 80% acetic acid. The fabric is then steamed for 15 minutes at 100° C., rinsed, and dried at 60° C. The cotton backing of the fabric is then sprayed with a liquor containing 16.0 g/l of the dye of formula

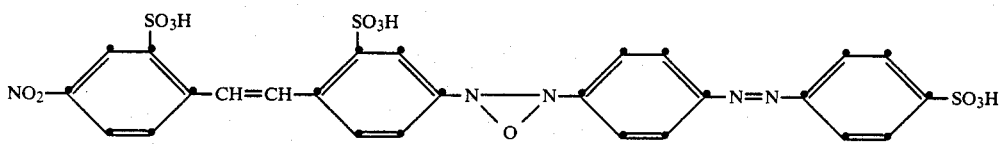

(15)

8.0 g/l of the dye of formula

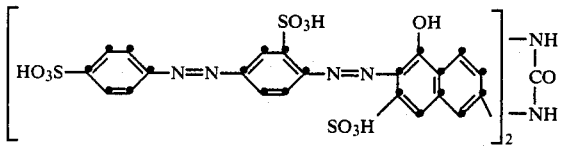

(16)

7.0 g/l of the dye of formula

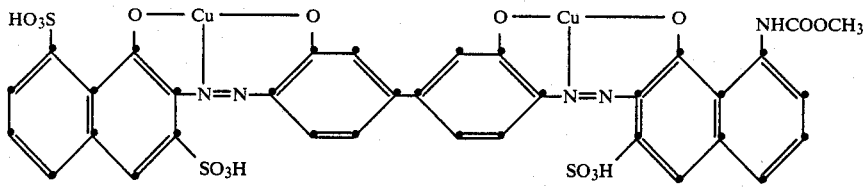

(17)

100 g/l of urea 2 g/l of the graft polymer prepared in Example 2, and 3 g/l of an aqueous wetting agent as used in Example 1.

Spraying is effected by a jet. The plush fabric is then stored airtight for 16 hours at 25° C. and subsequently rinsed and dried at 50° C.

Spraying results in the dye solution being applied where it is required, so avoiding complete penetration of the entire fabric. A level brown dyeing is obtained on both sides of the fabric.

Comparable dyeings are obtained after spraying by fixing the dye by steaming for 5 minutes at 100° C., by a microwave treatment for 5 minutes at 98° C., or by a thermosol treatment for 30 seconds at 210° C.

The back of the fabric can thus be dyed in an efficient and economical manner. Spraying can be effected direct after dyeing the polyacrylonitrile fibres without an intermediate drying (wet-in-wet dyeing).

Example 3

A cotton plush knitted fabric with polyester backing (80:20) having a mass per unit per area of 280 g/m$^2$ is sprayed from a jet with a liquor containing 30 g/l of the dye of formula

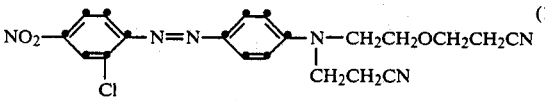

(18)

3 g/l of the graft polymer prepared in Example 2

3 g/l of an aqueous wetting agent and 0.5 ml/l of 80% acetic acid, with the rate of flow being so adjusted as to give a liquor pick-up of 60%. The fabric is then dried in a drying unit at 120° C. and subsequently subjected to a thermosol treatment for 60 seconds at 210° C.

Dyeing of the cotton plush is then carried out with a dye liquor containing 50 g/l of the dye of formula

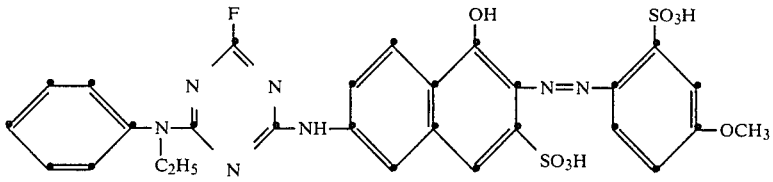

(19)

5 g/l of the graft polymer prepared in Example 2
5 g/l of an aqueous wetting agent
15 ml/l of 30% sodium hydroxide solution and
75 ml/l of sodium silicate solution (silicate content: 26.3–27.7%).

The fabric is then padded in one passage to give a liquor pick-up of 110%. The plush fabric is then put into a container, sealed airtight, and stored for 6 hours at 25° C. The fabric is then rinsed and given a washing off at boiling temperature with a non-ionic detergent (0.5 g/l of the adduct of 9 moles of ethylene oxide with 1 mole of nonylphenol) in a liquor ratio of 1:40. A strong, level red dyeing is obtained on both sides of the fabric. Comparable effects are obtained by using equal amounts of the graft polymers prepared in Examples 1 and 4 instead of the graft poplymer of Example 2.

Example 4

The fabric back of a cotton (web)/polyamide 6,6 blended knit article (80:20), having a mass per unit area of 360 g/m$^2$, is sprayed from a jet with a liquor containing
20 g/l of the dye of formula

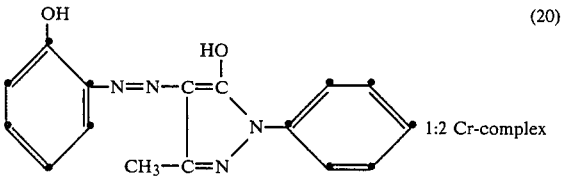

(20)

3 g/l of the graft polymer prepared according to Example 2
2 g/l of an aqueous wetting agent and
2 ml/l of 80% acetic acid
with the rate of flow being so adjusted as to give a pick-up of 80%. The fabric is then steamed for 5 minutes at 100° C., rinsed and subsequently pinched-off on the pad to reduce the moisture content to 50%.

The cotton component is then pad-dyed to a pick-up of 110% with a liquor containing
50 g/l of the dye of formula (19)
5 g/l of the graft polymer prepared according to Example 2
5 g/l of an aqueous wetting agent
15 ml/l of 30% sodium hydroxide solution and
75 ml/l of sodium silicate solution (silicate content: 26.3–27.7%)

The blend is then put into a container, stealed airtight, and stored for 6 hours at 25° C. The goods are then rinsed and given a washing off for 20 minutes at boiling temperature with a non-ionic detergent (0.5 g/l of the adduct of 9 moles of ethylene oxide with 1 mole of nonylphenol) in a liquor ratio of 1:40. The blend is again rinsed and dried. A level red dyeing is obtained on both sides of the fabric.

What is claimed is:

1. A process for dyeing cellulosic textile fabric with substantive or reactive dyes, which comprises impregnating said fabric with an aqueous dye liquor by a non-pad method and fixing the dyes by means of a heat treatment or by the cold pad-batch method, said dye liquor containing, in addition to dyes, a homopolymer or copolymer of acrylamide or methacrylamide, or a graft polymer of an adduct of an alkylene oxide and an at least trihydric aliphatic alcohol containing 3 to 10 carbon atoms and acrylamide or methacrylamide.

2. A process according to claim 1, wherein the dye liquor contains the polymer in an amount of 0.1 to 20 g/l in the form of an aqueous solution.

3. A process according to claim 1, wherein the dye liquor contains the polymer in an amount of 0.5 to 10 g/l, in the form of a 2 to 10% aqueous solution.

4. A process according to claim 1, wherein the graft polymer is of an adduct of 4 to 100 moles of propylene oxide with 1 mole of a trihydric to hexahydric alkanol of 3 to 6 carbon atoms and acrylamide or methacrylamide.

5. A process according to claim 1, wherein the graft polymer contains 2.5 to 50% by weight of the adduct and 50 to 97.5% of the grafted acrylamide or methacrylamide, based on the total graft polymer.

6. A process according to claim 5, wherein the graft polymer contains 2.5 to 30% by weight of the adduct and 70 to 97.5% by weight of the grafted acrylamide or methacrylamide, based on the total graft polymer.

7. A process according to claim 1, wherein the graft polymer has been prepared from acrylamide and an adduct of 40 to 80 moles of propylene oxide with 1 mole of glycerol.

8. A process according to claim 7, wherein the graft polymer contains 4 to 20% by weight of the adduct of 40 to 80 moles of propylene oxide with 1 mole of glycerol and 80 to 96% by weight of acrylamide, based on the total graft polymer.

9. A process according to claim 1, wherein the dye liquor contains reactive dyes.

10. A process according to claim 9, wherein the dye liquor additionally contains fixing alkalis.

11. A process according to claim 1, wherein the dye liquor additionally contains an alkali-resistant wetting agent.

12. A process according to claim 11, wherein the wetting agent comprises (A) an alkylsulfonate having 8 to 20 carbon atoms in the alkyl moiety, and (B) an adduct of 2 to 40 moles of ethylene oxide with 1 mole of a fatty alcohol or fatty acid, each containing 8 to 22 carbon atoms, or with 1 mole of an alkylphenol containing a total of 4 to 12 carbon atoms in the alkyl moiety.

13. A process according to claim 12, wherein component (B) of the wetting agent is an adduct of 2 to 10 moles of ethylene oxide with 1 mole of a fatty alcohol containing 8 to 12 carbon atoms.

14. A process according to claim 1, wherein impregnation is effected by spraying.

15. A process according to claim 1, wherein the dyes are fixed by the cold pad-batch method.

16. A process according to claim 1, wherein the dyes are fixed by steaming.

17. A process according to claim 1, wherein the dyes are fixed with microwaves.

18. A process according to claim 1, wherein the dyes are fixed by the thermosol process.

* * * * *